US005819713A

United States Patent [19]

Kesler

[11] Patent Number: 5,819,713

[45] Date of Patent: Oct. 13, 1998

[54] AUTOMOTIVE IGNITION CONTROL SYSTEM

[75] Inventor: Scott Birk Kesler, Kokomo, Ind.

[73] Assignee: Delco Electronics Corporation

[21] Appl. No.: 762,092

[22] Filed: Dec. 9, 1996

[51] Int. Cl.[6] ..... F02P 3/055

[52] U.S. Cl. ..... 123/630; 123/643; 307/39; 307/41

[58] Field of Search ..... 123/630, 632, 123/146.5 D, 643; 307/38, 39, 41

[56] References Cited

U.S. PATENT DOCUMENTS

| | | | |
|---|---|---|---|
| 3,745,985 | 7/1973 | Höhne | 123/630 |
| 4,106,460 | 8/1978 | Kopera | 123/632 |
| 4,249,506 | 2/1981 | Tada | 123/643 |
| 4,368,717 | 1/1983 | Roberts et al. | 123/632 |
| 4,402,299 | 9/1983 | Nakao et al. | 123/632 |
| 4,522,186 | 6/1985 | Hashizume | 123/643 |
| 4,774,925 | 10/1988 | Iwata | 123/632 |
| 4,893,605 | 1/1990 | Ozawa | 123/632 |
| 5,284,124 | 2/1994 | Moriyama et al. | 123/643 |

FOREIGN PATENT DOCUMENTS

| | | |
|---|---|---|
| 2 492 004 | 10/1981 | France . |
| 63 306278 | 4/1989 | Japan . |
| 08 210232 | 12/1996 | Japan . |

*Primary Examiner*—Andrew M. Dolinar
*Attorney, Agent, or Firm*—Jimmy L. Funke

[57] ABSTRACT

An automotive ignition control system includes a vehicle control computer operable to provide electronic spark timing (EST) signals, a control circuit having a number of coil drive circuits connected thereto, a corresponding number of coil driver devices connected to respective ones of the coil drive circuits and a corresponding number of ignition coils connected to respective ones of the coil driver devices. The control circuit is responsive to an active state of any one of the EST signals to activate a corresponding one of the coil driver devices while inhibiting activation of all others. If any EST signal remains in an active state for an excessive time period, the control circuit is operable to lock-out the corresponding coil driver device from operation until such a fault condition is cleared. The control circuit is preferably operable to accomplish the lock-out function by gradually decreasing the coil current associated with the faulty EST signal in a fashion that does not generate a spark event.

19 Claims, 9 Drawing Sheets

AUTOMOTIVE IGNITION CONTROL SYSTEM

FIELD OF THE INVENTION

The present invention relates generally to automotive ignition control systems, and more specifically to such systems including provisions for guarding against various input fault conditions.

BACKGROUND OF THE INVENTION

Computer control of automotive ignition systems has provided automobile manufacturers with the ability to gain highly sophisticated and reliable control over automotive ignition timing events while doing away with bulky and failure-prone mechanical components of previously known ignition systems. A typical computer-controlled automotive ignition system includes an engine control module (ECM) having a control computer operable to provide highly accurate ignition timing signals to an ignition control module which is, in turn, operable to control current, supplied by the automobile battery, through one or more ignition coils. The ignition control module typically consists of one or more integrated circuits coupled with a number of discrete electrical components and power switching devices. Functions of the module include reception of a number of ignition timing signals supplied by the ECM, logical manipulation of these signals to provide fault handling and controlled drive signals to the power switching devices connected to the corresponding number of ignition coils to dynamically control the current flowing through them.

Under normal operating conditions, the ignition control module receives an active one of a number of ignition timing signals, verifies that no other coil is currently being driven, and then activates the power switching device associated with that ignition timing signal. The ignition timing signal is typically activated for a sufficient duration to permit the current in the primary coil of the corresponding ignition coil to reach a predetermined current level, typically in the range of 6–10 amps. Once the predetermined coil current is achieved, the controlling signal to the power switching device is reduced to a level required to maintain a "hold" current therethrough. After a brief current limiting period, the ignition timing signal transitions to an inactive state and the power switching device is abruptly turned off. This abrupt transition of the power switching device from a conducting state to a non-conducting state stops the flow of current through the primary coil while leaving a high voltage condition thereacross. A resulting inductively-induced voltage spike occurs in the coil which causes a spark to occur across the gap of a spark plug connected to the coil secondary. This sequence is repeated for the remaining ignition coils in the system.

During the time period that the coil current is ramping to its hold level, the power dissipated by the power switching device is relatively low. However, during the current limiting period, a high level of power is dissipated by the power switching device since the voltage drop thereacross is defined by the battery voltage minus the voltage drop across the primary coil. This high voltage drop combined with the now high level of coil current results in a relatively high level of power that must be dissipated by the power switching device. If the power switching device is allowed to remain in this condition indefinitely, it will eventually be destroyed by excessive self-heating. Such continuous current flow may also eventually result in damage to, or destruction of, the ignition coil. It is therefore important to protect the system from input fault conditions that may cause the power switching device to remain on indefinitely.

Caution must be exercised, however, in protecting against such fault conditions. For example, if an ignition timing signal has remained in its activated state for an excessively long time period and the associated power switching device is simply turned off in an effort to protect the switching device and corresponding ignition coil, a spark event will occur at the associated spark plug as previously described. Unfortunately, this spark event will occur at a point in time when the piston is at a position other than that required for normal engine operation. Such a mis-timed spark event could cause damage to the piston and other engine components. It is therefore important not only to provide for protection against input fault conditions that may cause a power switching device to remain on indefinitely, but to further control the reduction of coil current in response thereto in such a fashion so as to avoid generation of an unwanted spark event.

What is therefore needed is an automotive ignition control system operable to "lock-out" an ignition timing signal exhibiting a fault condition corresponding to an ignition timing signal remaining active for an excessive time period, while responding normally to other functioning ignition timing signals. Such a system should further monitor the ignition timing signal exhibiting the fault condition, and resume normal operation with respect thereto if the faulty signal returns to normal operation. Ideally, such a system should accomplish the lock-out function by performing a slow, or "soft", shutdown of the associated coil current in fashion that prevents the production of a spark event. Under normal operating conditions, such a system should further prevent simultaneous activation of more than one power switching device.

SUMMARY OF THE INVENTION

The present invention addresses the foregoing concerns of the prior art computer controlled automotive ignition systems. In accordance with one aspect of the present invention an electrical load driving system comprises an electrical load, a load driving device operatively connected to the load and responsive to a load driving signal to enable current to flow from a source of current through the load, and a control circuit responsive to an active state of a load control signal to produce the load driving signal. The control circuit is operable to inhibit the load driving signal in response to the load control signal remaining in its active state for a predefined time period and disable further production of the load driving signal until the load control signal transitions from its inactive state to its active state.

In accordance with another aspect of the present invention, an electrical load driving system comprises a plurality of electrical loads, a plurality of load driving devices each operatively connected to a separate one of the loads and responsive to one of a corresponding plurality of load driving signals to enable current flow therethrough from a source of current, and a control circuit responsive to an active state of any one of a plurality of load control signals to produce a corresponding one of the plurality of load driving signals while inhibiting production of all other load driving signals. The control circuit is further responsive to an inactive state of the particular load control signal to inhibit production of only the corresponding load driving signal.

In accordance with yet another aspect of the present invention, an electrical load driving system comprises an electrically inductive load having a primary coil coupled to a secondary coil, a load driving device operatively connected to the primary coil, wherein the load driving device is responsive to an active state of a first signal to enable current to flow from a source of current through the load and to an abrupt transition from its active state to an inactive state of the first signal to produce a voltage spike in the secondary coil, and a control circuit responsive to an active state of a second signal to produce the active state of the first signal. The control circuit is operable to gradually decrease the first signal from its active state to its inactive state to avoid production of the voltage spike in the secondary coil in response to a fault condition associated with the second signal.

One object of the present invention is to provide an automotive ignition control system operable to "lock-out" an ignition timing signal exhibiting a fault condition corresponding to an ignition timing signal remaining active for an excessive time period, while responding normally to other normally functioning ignition timing signals.

Another object of the present invention is to provide such a system operable to further monitor the ignition timing signal exhibiting the fault condition, and resume normal operation with respect thereto if the faulty signal returns to normal operation.

Yet another object of the present invention is to provide such a system that accomplishes the lock-out function by performing a slow, or "soft", shutdown of the associated coil current in fashion that prevents the production of a spark event.

Still a further object of the present invention is to provide an automotive ignition control system operable to prevent simultaneous conduction of coil current through more than one ignition coil.

These and other objects of the present invention will become more apparent from the following description of the preferred embodiment.

DESCRIPTION OF THE PREFERRED EMBODIMENT

Figure 1:
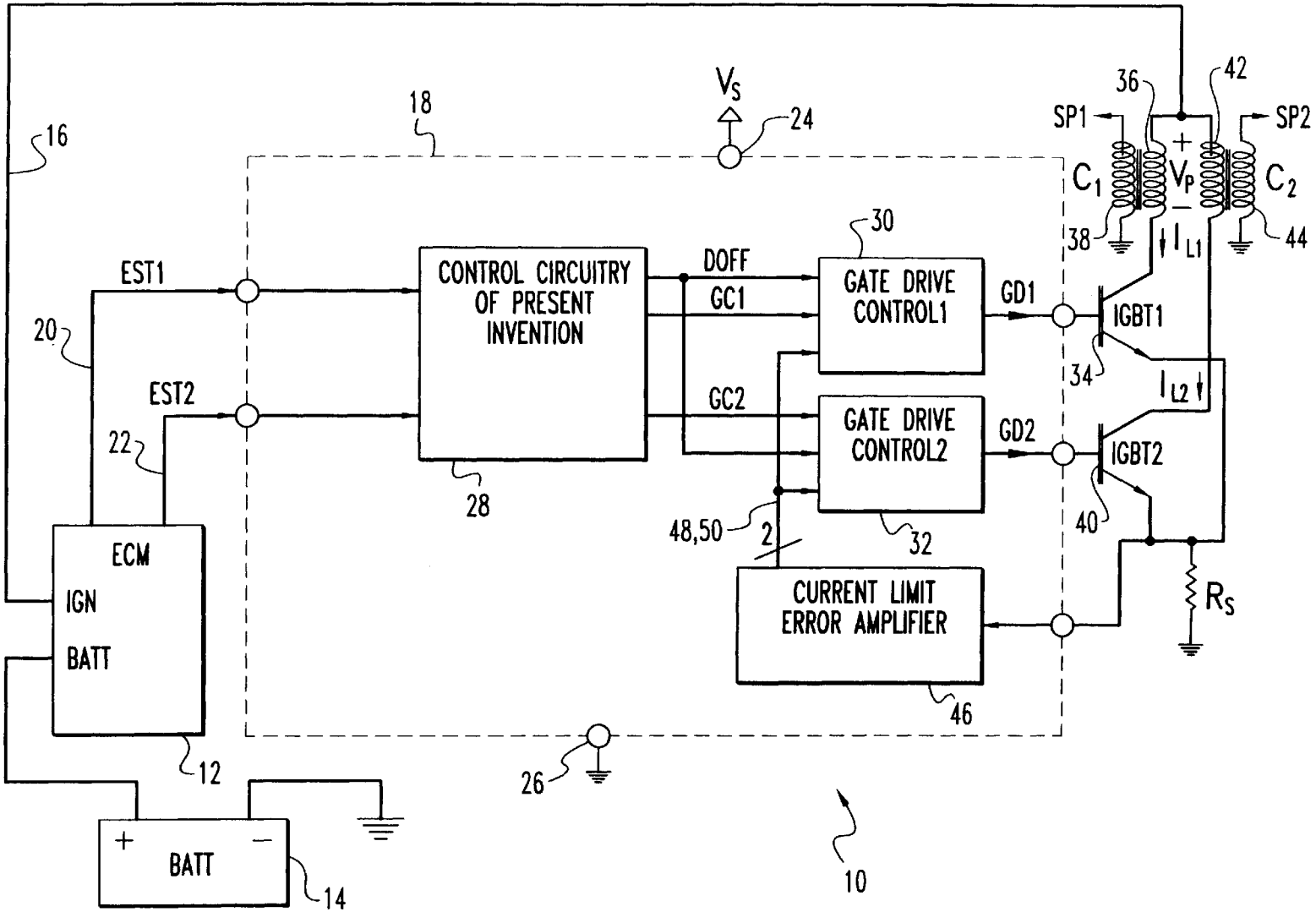
FIG. 1 is a diagrammatic illustration of one preferred embodiment of an automotive ignition control system in accordance with one aspect of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a diagrammatic illustration of one preferred embodiment of an automotive ignition control system 10, in accordance with one aspect of the present invention, is shown. System 10 includes an engine control module (ECM) 12, which is preferably microprocessor-based and is operable to control several engine and vehicle functions including the automotive ignition system. A power source 14, preferably an automotive battery, supplies ECM 12 with electrical power at input BATT. ECM 12 preferably includes a switch (not shown) which is responsive to an operator command for engine operation to switch battery voltage BATT to output IGN as is known in the art. Output IGN supplies switched battery voltage BATT to various engine and vehicle systems via signal path 16. Preferably, battery voltage BATT is within the range of approximately 12–16 volts, although the present invention contemplates battery voltages BATT of between approximately 7–24 volts.

As it relates to automotive ignition control system 10, ECM 12 is operable to produce a number of engine spark timing signals (EST) in accordance with engine ignition timing information computed from a number of engine and vehicle operating parameters as is known in the art. Although it is to be understood that ECM 12 may be operable to produce any number of such EST signals, and that automotive ignition control system 10 may be correspondingly operable to control any number of automotive ignition coils corresponding thereto, the figures shown and described herein will assume two EST inputs, EST1 provided by ECM 12 on signal path 20, and EST2 provided by ECM 12 on signal path 22.

Signals EST1 and EST2 are provided by ECM 12 to an automotive ignition control circuit 18 which is operable to process the EST signals and control automotive ignition coils $C_1$ and $C_2$ in accordance therewith. Preferably, automotive ignition control circuit 18 is formed of a single integrated circuit, using known integrated circuit fabrication techniques, although the present invention contemplates that automotive ignition control circuit 18 may be alternately constructed from discrete electrical components, or as an amalgamation of integrated circuits and discrete electrical components. In either case, circuit 18 includes a power supply input 24 receiving a suitable voltage $V_S$, and a ground reference input 26.

Control signals EST1 and EST2 are provided to the control circuitry of the present invention 28, which is operable to supply a first gate control signal GC1 to gate drive control1 circuit 30, and a second gate control signal GC2 to gate drive control2 circuit 32. Gate drive control1 circuit 30 and gate drive control2 circuit 32 may be known gate drive control circuits, as will be discussed hereinafter, and are operable to provide gate drive signals GD1 and GD2, respectively. Automotive ignition control circuit 18 produces gate drive signals GD1 and GD2 as outputs thereof, which are used to control power switching devices as will be described more fully hereinafter. Control circuit 28 is further operable to provide a signal DOFF to each of the gate drive control circuits 30 and 32, to deactivate gate drive signals GD1 and GD2 as will be discussed hereinafter.

Gate drive signal GD1 is connected to a control input of a first power switching device, and gate drive signal GD2 is likewise connected to a control input of a second power switching device. Preferably, each of the power switching devices are known power transistors. Examples of such power transistors suitable for use with the present invention include an insulated gate bipolar transistor (IGBT) as shown in FIG. 1, a power MOSFET, a bipolar power transistor, or the like. Each of the foregoing transistor examples include a control input which will be referred to hereinafter as a "gate". As shown in FIG. 1, gate drive output GD1 is preferably connected to a gate 34 of IGBT1, wherein IGBT1 has a collector connected to a primary coil 36 of automotive ignition coil $C_1$. A secondary ignition coil 38 is coupled to primary ignition coil 36 and has an output connected to at least one spark plug SP1. The opposite end of primary coil 36 is connected to switched battery voltage IGN via signal path 16. When gate drive signal GD1 is in an active state, IGBT1 is operable to conduct load current $I_{L1}$ therethrough from IGN through primary coil 36, and to ground potential through sense resistor $R_S$ connected to an emitter thereof. At any given time, primary coil 36 has a voltage $V_P$ thereacross which will be discussed more fully hereinafter.

Gate drive signal GD2 is similarly connected to a gate 40 of IGBT2, which has a collector connected to a primary coil 42 of automotive ignition coil $C_2$, and an emitter connected to sense resistor $R_S$. A secondary coil 44 is coupled to primary coil 42, and has an output connected to one or more spark plugs SP2. As with primary coil 36, primary coil 42 is connected to switched battery voltage IGN via signal path 16. IGBT2 operates identically to IGBT1 in that an active state of gate drive signal GD2 causes IGBT2 to conduct load current $I_{L2}$ from IGN through primary coil 42, through IGBT2, and to ground potential through sense resistor $R_S$. The common connection of the emitters of IGBT1 and IGBT2 and sense resistor $R_S$ is fed back through circuit 18 to a current limit error amplifier 46. Current limit error amplifier 46 is connected to gate drive control1 circuit 30 and gate drive control2 circuit 32 preferably via a pair of signals paths 48 and 50 as shown in FIG. 1. In operation, current limit error amplifier 46 is operable to sense a voltage across sense resistor $R_S$ and modulate gate drive signals GD1 and GD2 to reduced signal levels when the voltage across $R_S$ reaches a predefined level as is known in the art.

Figure 2:
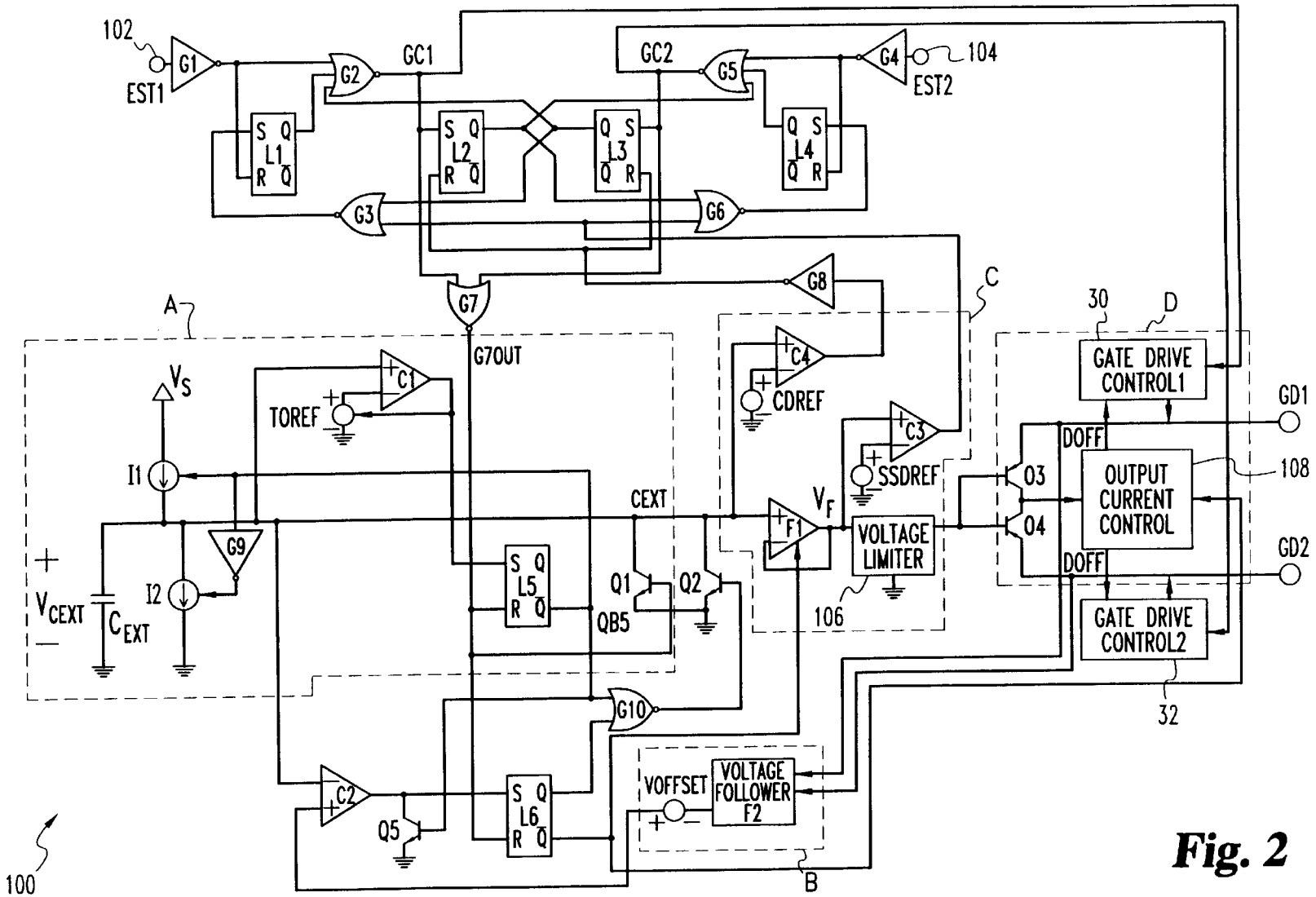
FIG. 2 is a block diagram illustration of one preferred embodiment of a control circuit particularly suited for use in the automotive ignition control system of FIG. 1, in accordance with another aspect of the present invention.

Referring now to FIG. 2, one preferred embodiment 100 of control circuit 28 of FIG. 1, in accordance with another aspect of the present invention, is shown. Control circuit 100 includes a first input 102 for receiving a logical representation of ignition timing signal ESTI thereat, and a second input 104 for receiving a logical representation of ignition timing signal EST2 thereat. Input 102 is connected to an inverter G1, the output of which is connected to one input of a three input NOR gate G2 and to a reset input of an RS flip-flop L1. The Q output of L1 is connected to a second input of NOR gate G2, and a set input of L1 is connected to an output of a two input NOR gate G3.

An output of NOR gate G2 is connected to a set input of RS flip-flop L2, one input of a two input NOR gate G7, and to gate drive control 1 circuit 30. The output of NOR gate G2 provides gate control signal GC1 to gate drive control1 circuit 30 as shown in FIG. 1. A Q output of L2 is connected to one input of a three input NOR gate G5 and to one input of a two input NOR gate G6. A reset input of L2 is connected to a reset input of an RS flip-flop L3, and to an output of an inverter G8. The Q output of L3 is connected to the remaining input of NOR gate G2 and to one input of a two input NOR gate G3. The set input of L3 is connected to an output of NOR gate G5, and to the remaining input of NOR gate G7. The output of NOR gate G5 is connected to gate drive control2 circuit 32, and provides gate control signal GC2 thereto.

A second input of NOR gate G5 is connected to a Q output of an RS flip-flop L4, and the remaining input of NOR gate G5 is connected to an output of an inverter G4, and to a reset input of L4. The input of inverter G4 provides input 104 to ignition timing signal EST2. A set input of L4 is connected to an output of NOR gate G6. The remaining inputs of NOR gates G3 and G6 are connected together, and further to an output of a comparator C3. The input of inverter G8 is connected to an output of another comparator C4.

The output of G7, labeled G7OUT in FIG. 2, is connected to a reset input of an RS flip-flop L5, a reset input of an RS flip-flop L6, and to the base of an NPN transistor Q1. A set input of L5 is connected to an output of a comparator C1, and also to a voltage source TOREF, which provides a reference voltage to an inverting input of C1. The Qbar output of L5, labeled QB5 in FIG. 2, is connected to a control input of a current source I1, an input of a two input NOR gate G10, and to the base of an NPN transistor Q5. The remaining input of NOR gate G10 is connected to the Q output of L6. The Qbar output of L6 is connected to a control input of a voltage follower F1 and to an output current control circuit 108. The output of NOR gate G10 is connected to the base of an NPN transistor Q2, which has an emitter connected to the emitter of Q1 and to ground potential. The set input of L6 is connected to an output of comparator C2 and to the collector of transistor Q5. A non-inverting input of comparator C2 is connected to a positive output of a voltage source VOFFSET, the negative end of which is connected to a voltage follower F2. Voltage follower F2 has a pair of inputs thereto, provided by GD1 and GD2, respectively. The inverting input of comparator C2 is connected to a signal path labeled CEXT in FIG. 2.

Signal path CEXT is connected to the collectors of transistors Q1 and Q2, a non-inverting input of comparator C1, the current receiving end of current source I1, of input to a second current source I2, and to a capacitor $C_{EXT}$. An opposite end of current source I1 is connected to supply voltage $V_S$, and output of current source I2 is connected to ground potential. The control input QB5 to current source I1 is passed through an inverter G9, the output of which provides a control input to current source I2. CEXT is also connected to a non-inverting input of comparator C4, which has an inverting input connected to a reference voltage CDREF.

Signal path CEXT is further connected to a non-inverting input of a voltage follower-connected comparator F1, an output of which is labeled $V_F$. $V_F$ is connected to a non-inverting input of comparator C3, which has an inverting input connected to a reference voltage SSDREF. $V_F$ is also connected to a voltage limiter 106, which has an output connected to the bases of PNP transistors Q3 and Q4. The collectors of Q3 and Q4 are connected together, and are further connected to the output current control circuit 108. The emitter of Q3 is connected to GD1, and the emitter of Q4 is connected to GD2. The output current control circuit 108 supplies signal path DOFF to gate drive control 1 circuit 30 and gate drive control2 circuit 32.

The control circuit 100 of FIG. 2 generally includes two circuit functions; (1) lock-out logic circuitry; and (2) time-out/soft-shutdown (TO/SSD) circuitry. The lock-out control logic controls drive circuitry 30 and 32, and sends, as well as receives, control signals from the TO/SSD circuitry. The TO/SSD circuitry includes analog circuitry that dynamically controls gate drive signals GD1 and GD2 during a soft-shutdown event, which will be more fully described hereinafter.

The basic operation of control circuit 100, as it relates to the automotive ignition control system 10 of FIG. 1, will now be described, followed by a more detailed description of the lock-out logic and TO/SSD functions of control circuitry 100. Thereafter, preferred circuit embodiments of the circuit blocks labeled A, B, C, and D in FIG. 2, will be described in detail.

BASIC OPERATION OF CONTROL CIRCUIT 100

Figure 3A:
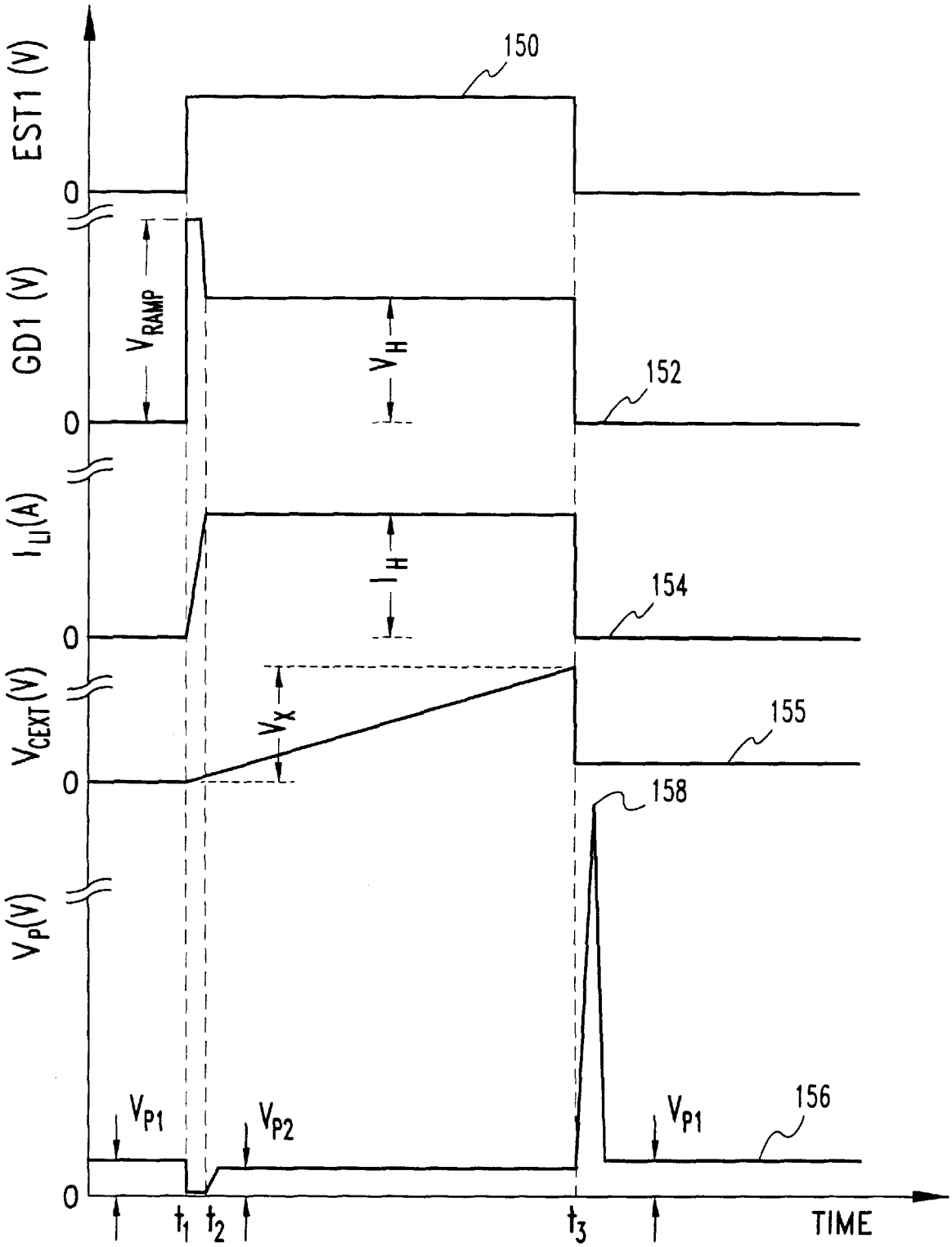
FIG. 3A is a plot illustrating some of the signals of the system of FIG. 1 during normal operation thereof.

Referring now to FIGS. 1, 2, and 3A, all circuit functions within control circuit 100 are reset by the condition of both EST1 and EST2 being in an inactive state. Preferably, EST1 and EST2 are inactive at a logic low level, and are active at a logic high level. However, the present invention contemplates that an inactive state of EST1 and EST2 may alternatively be a logic high level, and an active state thereof be a logic low level. In any case, an ignition timing input sequence begins with transition of either EST input from an inactive to an active state. If the lock-out logic feature of circuit 100 determines that the other EST signal is already active, the output corresponding to the active EST signal (either GD1 or GD2), is commanded to an active state from its inactive state, which turns on a corresponding drive transistor (IGBT1 or IGBT2). Preferably, the active state of gate drive outputs GD1 and GD2 correspond to a logic high level, while an inactive state thereof corresponds to a logic low level. Alternatively, as with the EST signals, the converse may be true. In either case, commanding the respective drive transistor on results in a current ramp-up in the corresponding ignition coil ($C_1$ or $C_2$).

The foregoing conditions are shown in FIG. 3A as signals 150 (EST1), 152 (GD1), and 154 ($I_{L1}$). During the "reset" period, the voltage $V_{P.156}$ across the primary coil 36 of coil $C_1$ is at a level defined by the voltage $V_{P1}$. At time $t_1$, EST1 150 transitions to its active state, which causes gate drive voltage GD1 152 to transition to $V_{RAMP}$. In response thereto, the load current $I_{L1}$ 154 begins to increase in value. During this time, the voltage $V_P$ drops to near zero. At time $t_2$, $I_{L1}$ reaches its "hold" value $I_H$ (the desired maximum coil current level), and current limit error amplifier 46 responds thereto by modulating gate drive signal GD1 to a reduced "hold" voltage $V_H$. During this current limiting period following $t_2$, the voltage $V_P$ increases to a value $VP_{P2}$ less than $V_{P1}$.

Concurrently with the foregoing system operation, capacitor $C_{EXT}$ (FIG. 2) begins charging at $t_1$ via current source I1, and continues to charge during the time period from $t_2$ to $t_3$. As shown by signal 155 in FIG. 3A, the voltage $V_{CEXT}$ across capacitor $C_{EXT}$ thus ramps to a level $V_X$ at time $t_3$, which is less than the reference voltage TOREF (FIG. 2). Under normal operation, EST1 transitions to its inactive state before $V_{CEXT}$ ramps to a level sufficient to qualify as an "excessive" dwell. Thus, at time $t_3$, EST1 150 transitions to its inactive state, thereby transitioning GD1 152, $I_{L1}$ 154 and $V_{CEXT}$ 155 to their inactive states, respectively. Due to the current level $I_H$ of the current $I_{L1}$ flowing through coil $C_1$, transitioning GD1 152 to its inactive state causes a voltage spike 158 after $t_3$, which results in a spark event at spark plug SP1. The voltage $V_P$ 156 returns thereafter to its reset value of $V_{P1}$.

Figure 3B:
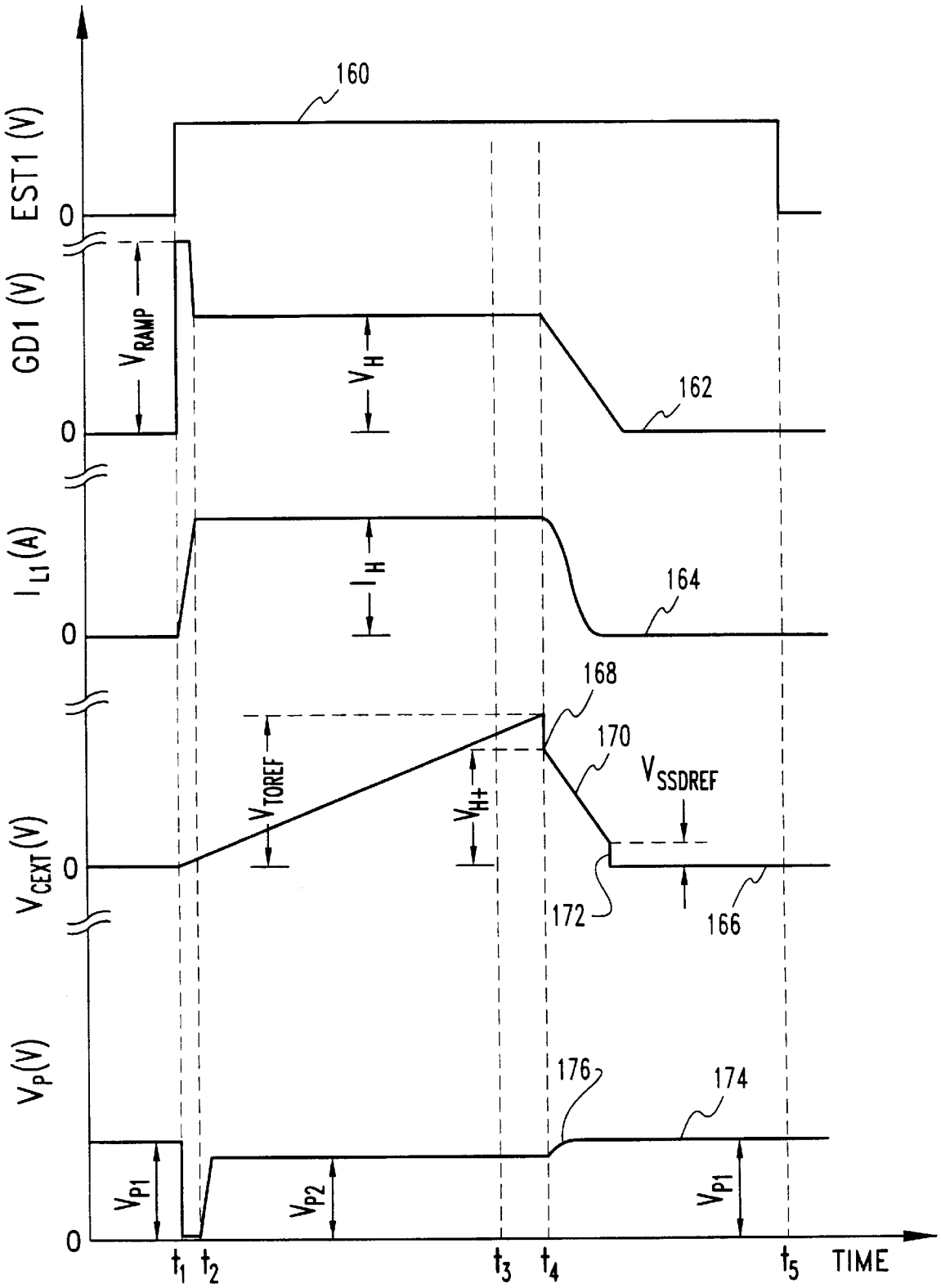
FIG. 3B is a plot illustrating some of the signals of the system of FIG. 1 during a fault condition associated with one of the input EST signals.

Referring now to FIGS. 1, 2, and 3B, a "soft-shutdown" event will now be described. The operation of EST1 160, GD1 162, $I_{L1}$ 164, and $V_P$ 174 are identical to their counterpart signals in FIG. 3A until time $t_3$. As shown in FIG. 3B, from time $t_1$ forward, the voltage $V_{CEXT}$ (across capacitor $C_{EXT}$) is linearly increasing under the influence of current source I1. If EST1 160 does not transition to its inactive state at time $t_3$ as expected, a time-out/soft-shutdown event is initiated thereafter when $V_{CEXT}$ charges to voltage $V_{TOREF}$ at subsequent time $t_4$. $V_{TOREF}$ corresponds to the reference voltage TOREF at the inverting input of capacitor C1 of FIG. 2. At time $t_4$, capacitor $C_{EXT}$ is used for a second function; that of providing a reference voltage for the IGBT during the soft-shutdown event.

At time $t_4$, the capacitor voltage $V_{CEXT}$ is simultaneously reduced to a value $V_{H+}$ 168 and forced through voltage follower F1 and voltage limiter 106 onto GD1. $V_{H+}$ corresponds to the voltage $V_H$ previously on GD1 plus a small offset voltage VOFFSET (see voltage follower F2 of FIG. 2). Once forced onto GD1, the voltage $V_{CEXT}$ on capacitor $C_{EXT}$ is slowly discharged via current source I2 as shown by linear portion 170 of signal $V_{CEXT}$. $V_{CEXT}$ linearly decreases until it reaches a voltage $V_{SSDREF}$, which is set at a voltage low enough to guarantee that the IGBT is effectively turned off. $V_{SSDREF}$ corresponds to the voltage reference SSDREF at the inverting input of capacitor C3 (FIG. 2). When $V_{CEXT}$ reaches $V_{SSDREF}$, capacitor $C_{EXT}$ is completely discharged, as shown by portion 172 of signal $V_{CEXT}$, in preparation for the next dwell event.

In response to the foregoing controlled discharge of capacitor $C_{EXT}$, GD1 162 is linearly decreased to its inactive state and $I_{LI}$ 164 correspondingly decreases at a sufficiently slow rate to result in a controlled increase 176 of $V_P$ 174 from $V_{P2}$ to $V_{P1}$. The controlled soft-shutdown of IGBT1 therefore does not result in the generation of a spark event at spark plug SP1. Circuitry 100 does not allow the next ignition timing event to start until it determines that capacitor $C_{EXT}$ is fully discharged so as to guarantee a full time-out period for the next incoming EST signal.

At the point $V_{CEXT}$ decreases to $V_{SSDREF}$, the lock-out logic portion of circuitry 100 effectively "locks out" the offending EST1 signal, and will not further process the EST1 signal until it returns to its inactive state, which is shown in FIG. 3B as occurring at time $t_5$. After $t_5$, circuitry 100 will respond to a transition of EST1 from its inactive to its active state as previously described. Having provided a basic description of the time-out/soft shutdown mechanism, a more detailed discussion of how each of the timing and control events are implemented will now be presented. The lock-out control logic will be discussed first, followed by a detailed discussion of the TO/SSD circuitry assuming prior understanding of the lock-out logic function.

LOCK-OUT LOGIC

Referring to FIG. 2, inverters G1 and G4, NOR gates G2, G3, G5, and G6, and RS flip-flops L1–L4 comprise the "lock-out logic" of control circuitry 100. As will be discussed hereinafter, the lock-out logic circuitry prevents more than one gate drive output (GD1 and GD2) to be enabled at any time, and further prevents the start of a new ignition timing sequence (dwell cycle) until a time-out event in progress has completed and the TO/SSD capacitor $C_{EXT}$ has been discharged.

Initially, all EST signals (EST1 and EST2) are low, resetting L1 and L4. Using EST1 as an example hereinafter, a low-level EST1 signal disables GD1 by imposing a high level input signal on NOR gate G2. With any high input signal on G2, signal GC1 (output of G2) is low, thereby commanding GD1 to an inactive state so that IGBT1 is turned off. Assuming that all EST input signals have been inactive for a time period sufficient to have fully discharged capacitor $C_{EXT}$, L2 and L3 will be reset, causing their Q outputs to be low. The foregoing description corresponds to a fully reset condition of control circuit 100.

As EST1 transitions to its active state, the output of inverter G1 transitions to a logic low level. With all three inputs to NOR gate G2 low, signal GC1 transitions to a logic high level. A high level GC1 signal causes gate drive control1 circuit 30 to turn on IGBT1 by raising the voltage at gate 34 to a level limited by voltage limiter 106. Voltage limiter circuitry 106 prevents excessive voltage from damaging the gate 34 of IGBT1, but must be set high enough to guarantee sufficient gate drive to permit conduction of the desired level of $I_{L1}$.

The high level GC1 signal also sets L2 such that the Q output thereof is at a logic high level, thereby preventing any high level signal appearing at input 104 (EST2) from propagating past NOR gate G5 (due to the logic high level of the corresponding input to G5). This action "locks out" any EST signal other than EST1, and thereby prevents more than one IGBT from being driven at any time. The "lock-out" of EST2 will be terminated only upon reset of L2. L2 (and L3) are reset only when the voltage $V_{CEXT}$ discharges to a level below the CDREF voltage reference connected to the inverting input of comparator C4. This mechanism thus prevents the start of a new ignition timing sequence (dwell cycle) with charge remaining on capacitor $C_{EXT}$. This is necessary since a partially charged capacitor $C_{EXT}$ would result in a short time-out period on the next dwell cycle, which is an undesirable condition.

As previously discussed, EST1 would transition to its inactive state, during normal operation of system 10, before a time-out event occurs. In such a case, the logic low level of EST1 is passed through G1 and G2 to gate drive control1 circuit 30, and to NOR gate G7. With both inputs to G7 at a logic low level, signal G70UT transitions to a logic high level which resets L5 and turns on transistor Q1. The action of turning on Q1 causes a rapid discharge therethrough of capacitor $C_{EXT}$. When the voltage $V_{CEXT}$ drops below reference voltage CDREF, the output of comparator C4 transitions to a low state, which causes the corresponding logic high level at the output of G8 to reset L2 and L3, thereby "unlocking" input 104 and allowing an active EST2 signal to command its associated gate drive control2 circuit 32 to drive transistor IGB2. Along with L2 and L3, L1 and L4 are also provided with a reset signal, through the action of comparator C3 and NOR gates G3 and G6, although L1 and L4 are only set when a time-out/soft-shutdown event occurs, which will be described hereinafter.

As previously discussed, if EST1 remains in an active state for an excessively long time period, a time-out/soft-shutdown event is triggered. During the course of events resulting from a subsequent soft-shutdown, voltage follower F1 is enabled via the Qbar output of L6, thereby forcing $V_{CEXT}$ to the output thereof so that $V_F$ equals $V_{CEXT}$. When $V_F$ subsequently drops below SSDREF of comparator C3, pursuant to a soft-shutdown, the output of C3 transitions to a logic low level, which is supplied to NOR gates G3 and G6. With EST2 inactive or locked out, L3 is correspondingly reset so that its Q output is at a logic low level. With two logic low inputs to G3, the output of G3 transitions to a logic high level, thereby setting latch L1. L1's now high Q output prevents any high level signal at EST1 from propagating past G2. This sequence effectively locks out an offending "stuck high" EST signal, and allows normal operation of other EST inputs. L1 is, as described above, reset only when EST1 transitions back to a logic low level.

TIME-OUT/SOFT-SHUTDOWN CIRCUITRY

As previously described, under a fully reset condition, capacitor $C_{EXT}$ is fully discharged. When any EST signal transitions to its active state, current source I1 begins charging $C_{EXT}$ as shown by signal 166 of FIG. 3B. If the controlling EST signal remains in its active state for an excessively long time period, $C_{EXT}$ will charge to a voltage $V_{TOREF}$, which is the threshold reference voltage of comparator C1. Preferably TOREF is a fixed voltage level that is relatively independent of supply voltage, temperature, and integrated circuit process parameters. TOREF is also modified by the output of comparator C1 to provide hysteresis in the comparing function. When $V_{CEXT}$ reaches $V_{TOREF}$, the output of comparator C1 switches from a logic low state to a logic high state, setting L5. The on/off control of current sources I1 and I2 is dictated by the Qbar output of L5. When L5 is set, QB5 switches from a logic high level to a logic low level, thereby turning off current source I1 and turning on current source I2, which begins the discharge of $C_{EXT}$. Additionally, the transition of QB5 from a logic high to a logic low level turns off transistor Q5 which was previously activated to hold the output of comparator C2 low. L6 was previously reset (when L5 was reset) by NOR gate G7, and its Q output is therefore now in a logic low state.

With QB5 and the Q output of L6 both at a logic low level, the output of NOR gate G10 transitions to a logic high level, thereby turning on transistor Q2. Preferably, Q2 is sized to be capable of rapidly discharging capacitor $C_{EXT}$, which it does until L6 is set by a logic high level at the output of comparator C2. The output of comparator C2 switches from a logic low level to a logic high level when the voltage $V_{CEXT}$ drops below a level imposed on C2's non-inverting input by voltage follower F2.

Voltage follower F2 is designed so that the voltage imposed on C2's non-inverting input thereby is a few hundred millivolts above the voltage on GD1 (assuming EST1 is the active input). This results in $C_{EXT}$ being discharged down to a level just slightly above the voltage at GD1 ($V_{H+}$ as shown in FIG. 3B). When that level is reached, C2 switches to a logic high level, thereby setting L6 so that its Q output switches to a logic high level. This causes the output of G10 to switch to a logic low level, which turns off transistor Q2.

The setting of L6 switches its Qbar output to a logic low level which enables voltage follower F1 to pass the voltage $V_{CEXT}$ at its non-inverting input to its output as $V_F$. $V_F$ passes through voltage limiter 106, and through transistor Q3, so that a direct copy of $V_{CEXT}$ is imposed on GD1. Since current source I2 is currently active, $C_{EXT}$ is slowly discharged, resulting in a slow reduction of the voltage $V_{CEXT}$ imposed on the GD1 output. The rate of change of the GD1 voltage is designed to be slow enough that, for a given ignition coil inductance,.there is no appreciable voltage ring-up on the ignition coil primary due to the slowly decreasing current in IGBT1. This voltage slew rate is dictated primarily by the inductance of the ignition coil as described by relationship V=L*di/dt. This slew rate should be chosen such that no voltage capable of generating a spark or other dangerous voltage is generated on the coil secondary 38.

The discharge of $C_{EXT}$ continues until $V_{CEXT}$ is reduced to a level defined by SSDREF, which is the threshold reference voltage at the inverting input of comparator C3.

Preferably, SSDREF is chosen to be a voltage below the gate threshold voltage of IGBT1, thereby guaranteeing that when $V_{CEXT}$ is equal to SSDREF, no current is flowing through IGBT1. When this level is reached, the output of comparator C3 switches to a logic low level, which is provided to NOR gates G3 and G6 as previously described. This signal causes termination of gate control signal GC1 by setting L1. The lock-out logic then causes a rapid discharge of $C_{EXT}$ via transistor Q1 by forcing G7out to a logic high level. $C_{EXT}$ is then rapidly discharged down to very near ground potential, as detected by comparator C4. When C4 detects that $V_{CEXT}$ is below CDREF, its output switches to a logic low level, which causes inverter G8 to reset L2 and L3. This action permits an active EST2 signal to proceed unimpeded, and the time out cycle can thus be restarted with a guarantee of a full $C_{EXT}$ charging cycle.

The inverters, NOR gates, and RS flip-flops shown in FIG. 2 may be of known construction and need not be further described herein. In one preferred embodiment, such devices are constructed from resistors and bipolar transistors. However, those skilled in the art will recognize that such devices may be constructed from other known electrical components without detracting from the scope of the present invention. In any case, preferred embodiments of the remaining circuits comprising control circuit 100 will now be described.

Figure 4:
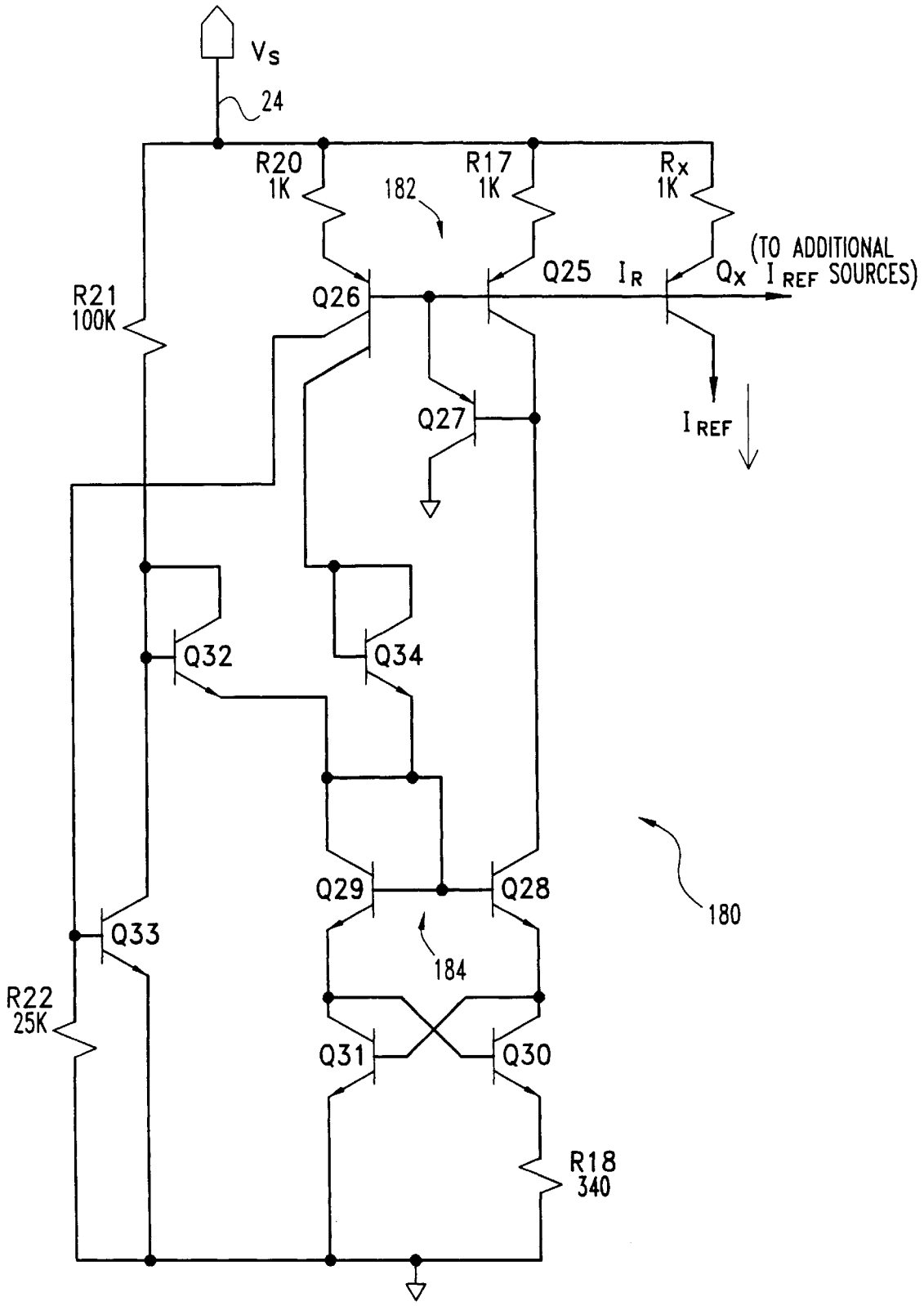
FIG. 4 is a schematic diagram illustrating one preferred embodiment of a reference current generating circuit particularly suited for use with the control circuit of FIG. 2.

Referring now to FIG. 4, one preferred embodiment of a circuit 180 for generating bias and operating currents for control circuit 100 is shown. Transistors Q25, Q26, and Q27 comprise a known current mirror arrangement 182 connected to a second current mirror arrangement 184 composed of transistors Q28 and Q29, which passes the mirrored current through trans-coupled transistors Q30 and Q31. Resistor R18 is connected between the emitter of Q30 and ground potential, and a number of transistors $Q_X$ form a current mirror with Q25 and Q27 so as to supply current $I_{REF}$. The reference current $I_{REF}$ is defined by the equation:

$$I_{REF}=V_t*ln(9)/R18.$$

$I_{REF}$ is a standard "delta $V_{be}$" current and is generated by known circuitry. $V_t$ is the thermal voltage defined by well known equations. The temperature characteristic of $I_{REF}$ is generally positive, and the current is independent of supply voltage $V_S$ 24. Using base drive current $I_R$, scaled copies of the current $I_{REF}$ are generated using $R_X$ and $Q_X$ to bias most of the internal circuitry of control circuit 100.

Figure 5:
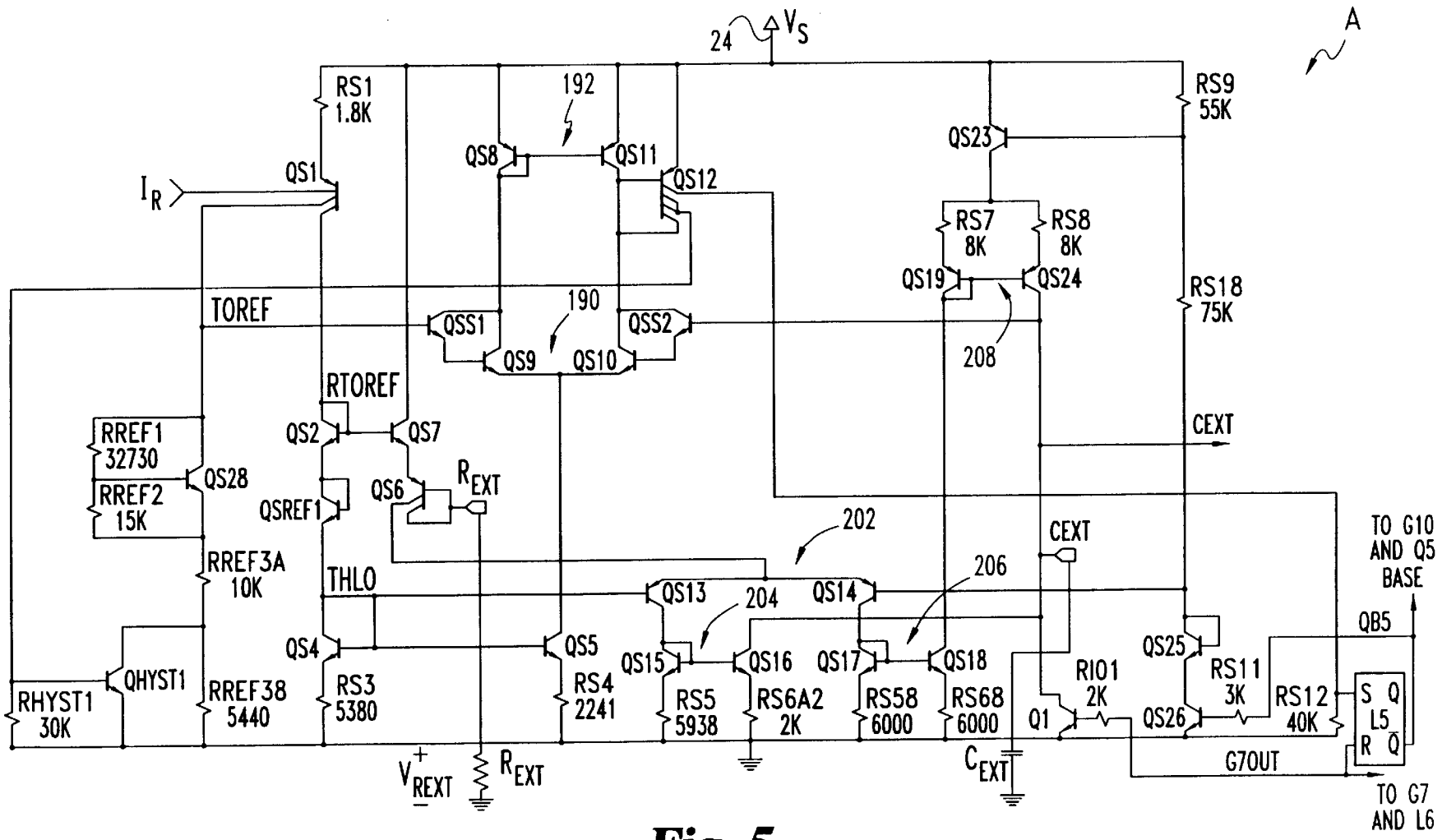
FIG. 5 is a schematic diagram illustrating one preferred embodiment of the block of circuitry labeled "A" in FIG. 2.

Referring now to FIG. 5, one preferred embodiment of the block A circuitry of FIG. 2 is shown. Transistors QSS1, QSS2, and QS8–12 make up a standard Darlington input comparator C1 which monitors the voltage $V_{CEXT}$ and compares this voltage to the reference voltage TOREF. The base of transistor QSS1 is connected to the collector of transistor QS28 and a resistor RREF1. The opposite end of RREF1 and one end of a resistor RREF2 are connected to the base of QS28, and the opposite end of RREF2 is connected to the emitter of QS28. The emitter of QS28 is further connected to one end of a resistor RREF3A, the opposite end of which is connected to resistor RREF3B and to the collector of a transistor QHYST1. The base of QHYST1 is connected to a resistor RHYST1 and to a collector of an output transistor QS12, of comparator C1.

The voltage TOREF provided at the base of transistor QSS1 is a pseudo-bandgap voltage developed across QS28 and resistors RREF3A and RREF3B. TOREF is approximately described by the equation:

$$TOREF=[(I_{REF}/2)*(RREF3A+RREF3B)]+(1+RREF1/RREF2)*Vbe_{QS28},$$

where $I_{REF}$ is the delta-Vbe reference current described with respect to FIG. 4 and $Vbe_{QS28}$ is the base-to-emitter voltage of transistor QS28. Since diffused silicon integrated circuit resistors have a positive temperature coefficient, and NPN base-emitter voltages have a negative temperature coefficient, the values of RREF1, RREF2, RREF3A, and RREF3B can be chosen so that the magnitude of TOREF is substantially independent of temperature. The use of the known Vbe "multiplier" structure of QS28, RREF1, and RREF2 provides the circuit designer with greater flexibility in the level at which TOREF must be set to achieve temperature independence by permitting the use of non-integral multiples of Vbe voltages. A traditional voltage reference uses a series combination of NPN diodes to achieve the negative T.C. voltage used to offset the positive voltage across the silicon diffused resistors. This topology, however, limits the solution points for zero temperature coefficient performance to integral multiples of the silicon bandgap voltage (approximately 1.26 volts), each multiple corresponding to each diode on the diode stack. By using a Vbe multiplier of the type described herein, a non-integral number of Vbe's can be generated, thereby allowing the circuit to be designed for substantially temperature independent operation of TOREF at a wider range of voltages. Such a structure alternatively allows the TOREF reference voltage to be designed to have a non-zero temperature coefficient to offset any temperature dependencies in the associated circuitry. The calculations necessary to determine the required resistor values to achieve such a non-zero temperature coefficient for TOREF are known to those skilled in the art. In either case, the TOREF reference voltage is independent of supply voltage $V_S$ 24.

The rate at which the capacitor $C_{EXT}$ is charged and discharged is determined by the value of the external resistor $R_{EXT}$. The voltage across $R_{EXT}$, and thereby the current through it, is determined by the voltage established at the base of transistor QS6. Transistor QS6 is a PNP transistor having one collector connected to its base, a second collector connected to differential stage 202 comprising transistors QS13 and QS14, and an emitter connected to an emitter of NPN transistor QS7. QS7 is connected, in a voltage follower configuration, to NPN transistor QS2. The emitter of transistor QS2 is connected to a diode configured NPN transistor QSREF1, the emitter of which is connected to the collector and base of transistor QS4 and base of transistor QS13. Transistor QS4 is connected, in a current mirror arrangement, with transistor QS5, which has a collector connected to the emitters of transistors QS9 and QS10. The emitter of transistor QS4 is coupled to ground potential via resistor RS3, and the emitter of QS5 is coupled to ground through resistor RS4. The voltage $V_{REXT}$ is approximately described by the equation:

$$V_{REXT}=(I_{REF}*RS3)+Vbe_{QS4},$$

where it is assumed that the Vbe's of transistors QS6 and QS7 cancel with those of transistors QS2 and QSREF1. The voltage $V_{REXT}$ is thus the same voltage as that appearing at the base of transistor QS13, which is labeled THLO. THLO is a pseudo-bandgap voltage and, given the appropriate choice of RS3, can be designed to be substantially temperature independent. THLO is also independent of supply voltage $V_S$ 24.

Since one collector of QS6 is connected to its base, and is further connected to $R_{EXT}$, the current flowing therethrough is mirrored to the remaining collector which is provided to the comparator composed of QS13 and QS14. The base of transistor QS14 is connected to a diode connected transistors QS25, which has an emitter connected to a collector of a transistor QS26. The base of transistor QS26 is connected to signal QB5 (FIG. 2). Transistors QS25 and QS26, and voltage THLO are designed such that when signal QB5 is low, transistor QS13 directs the $R_{EXT}$ current through current mirror 204, composed of transistors QS15 and QS16, and which comprises current source I2 (FIG. 2). Since the collector of QS16 is connected to capacitor $C_{EXT}$, $C_{EXT}$ is discharged at a rate defined by the $R_{EXT}$ current flowing through current mirror 204. Preferably, transistors QS15 and QS16 are sized with respect to each other so as to scale the $R_{EXT}$ current replica to a magnitude necessary for the desired $C_{EXT}$ discharge rate.

On the other hand, when the signal QB5 is high, transistor QS14 directs the $R_{EXT}$ current through current mirror 206, composed of transistors QS17 and QS18, which is connected to a second current mirror 208, which is composed of transistors QS19 and QS24. Since the collector of transistor QS24 is connected to capacitor $C_{EXT}$, current mirrors 206 and 208 comprise current source I1 (FIG. 2). As with current mirror 204, transistors QS17, QS18, QS19, and QS24 are sized to scale the $R_{EXT}$ current replica to a magnitude necessary for the desired charge rate of capacitor $C_{EXT}$.

At the beginning of an ignition timing event, or dwell cycle, capacitor $C_{EXT}$ has been discharged by transistor Q1 which is driven by signal G7OUT. G7OUT is high when both EST signal inputs are low. This high G7OUT signal also resets L5 which causes signal QB5 to drive transistor QS26. QS26 sinks current through resistor RS10, thereby supplying base drive to PNP transistor QS23 which, in turn, supplies drive to the PNP current mirror composed of transistors QS19 and QS24. Since QS26 is turned on, the comparator composed of QS13 and QS14 is switched such that the $R_{EXT}$ replica current becomes a charging current as described hereinabove. Capacitor $C_{EXT}$ charges until its voltage reaches the same voltage as TOREF. At this point, which is the end of a time out period, comparator C2 switches, forcing the set input of L5 high. This forces the signal QB5 to a logic low level, which turns off transistor QS26. Transistor QSl3 is thus turned on and the capacitor $C_{EXT}$ begins discharging through current mirror 204. This discharging voltage is imposed, as will be described hereinafter, on the gate of IGBT1 to effect a soft-shutdown of the coil current $I_{L1}$. Also, as comparator C2 switches, transistor QHYSTl is turned on by transistor QS12, which pulls the circuit node connecting RREF3A and RREF3B to nearly ground potential. This action lowers TOREF, thereby resulting in hysteresis in the switch point of comparator C2. TOREF is returned to its previous level once the capacitor voltage $V_{CEXT}$ discharges to a level below the new TOREF voltage.

The foregoing charge/discharge cycle is completed only in the case of a persistent fault at one of the two EST inputs. In a normal dwell event, $V_{CEXT}$ does not reach the TOREF level, but is instead rapidly discharged when the G7OUT output switches high in response to all EST input signals being low.

Figure 6:
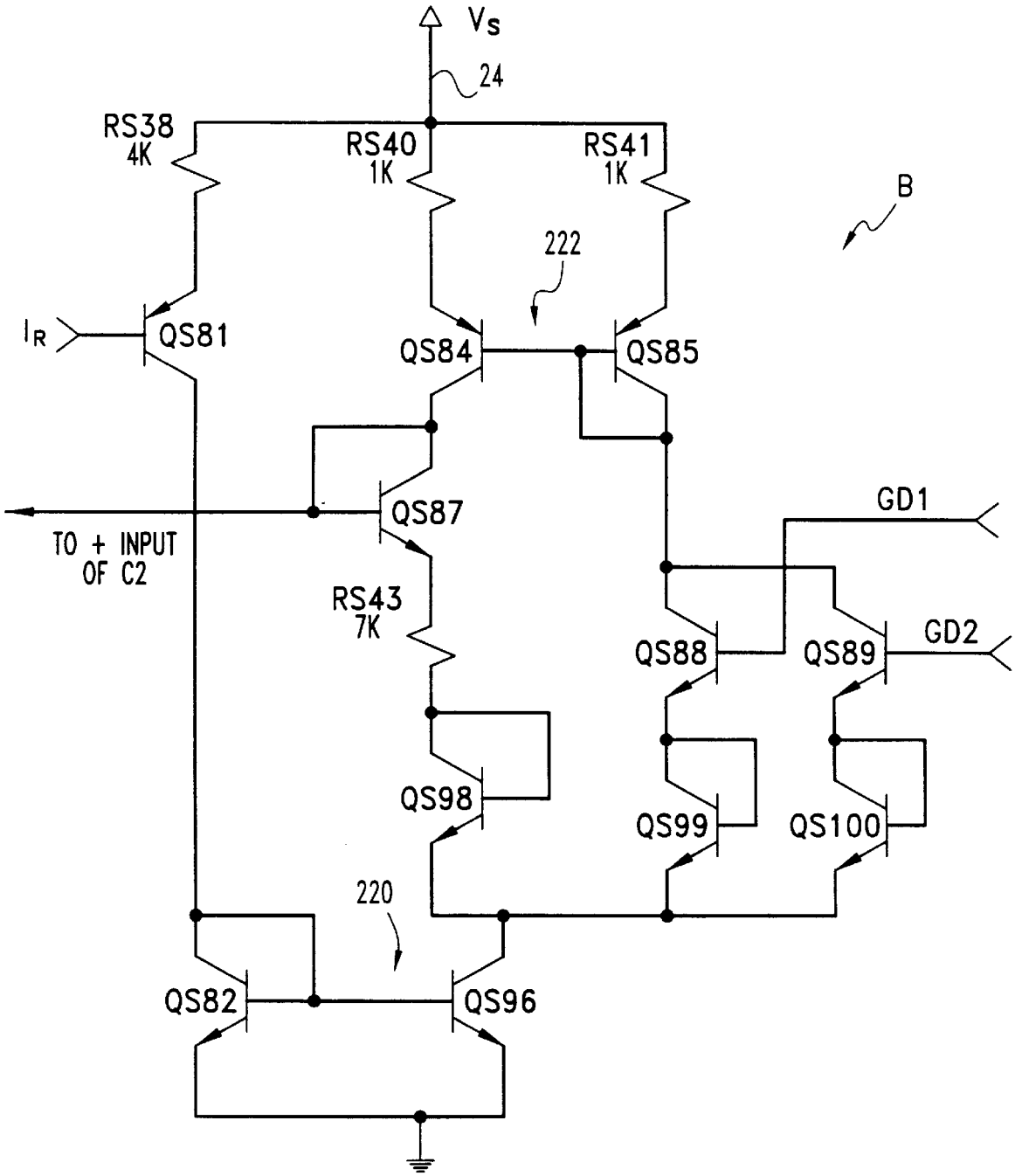
FIG. 6 is a schematic diagram illustrating one preferred embodiment of the block of circuitry labeled "B" in FIG. 2.

Referring now to. FIG. 6, one preferred embodiment of circuit block B of FIG. 2 is shown. Outputs GD1 and GD2 are connected to the base of transistor QS88 and QS89, respectively. Transistors QS99 and QS100 are diode-connected transistors connected to the emitters of QS88 and QS89, respectively. The collectors of QS88 and QS89 are connected together and to a current mirror 222 formed by transistors QS84 and QS85. Diode-connected transistor QS87 has an emitter connected to a resistor RS43, which is connected to diode-connected transistor QS98. The emitters of QS98, 99 and 100 are connected together, and to a current mirror 220 composed of transistors QS81, 82, and 96. The base-collector connection of transistors QS87 is connected to the non-inverting input of comparator C2.

The circuitry of FIG. 6 is used to control the adjustment of the capacitor voltage $V_{CEXT}$ to approximately the same level as the current limit stage gate drive output voltage GD1. This adjustment is made to the capacitor voltage $V_{CEXT}$ immediately before the start of a soft-shutdown event. This rapid shift in the voltage $V_{CEXT}$ is necessary to compensate for the variation in gate voltage required for various IGBTs and varying current limit levels. By adjusting the capacitor voltage $V_{CEXT}$ to a level slightly above the gate voltage prior to beginning a soft-shutdown event, the amount of time before reduction in coil current begins to decrease can be more easily controlled. This effectively permits a tighter control over the time-out time period. Control of this time-out time period is important in order to minimize the amount of time that the IGBT is in its highest power dissipation modes, which are (1) steady-state current limiting, and (2) soft-shutdown current ramping. It is during both of these stages of operation that the collector to emitter voltage on the IGBT is relatively high, and therefore the resulting power dissipation is high. Any "unnecessary" IGBT on time in a time-out or soft-shutdown sequence translates to increased heating of the IGBT, which is undesirable.

Comparator C2 is preferably a known PNP comparator which compares the voltage $V_{CEXT}$ to a replica of the higher of the two gate drive output voltages GD1 and GD2. This replica is generated by the voltage follower circuitry composed of transistors QS82, QS84–85, QS87–89, QS96, and QS98–100, as well as resistors RS40–41 and RS43. The NPN current mirror composed of QS82 and QS96 provides a bias current for the follower. The mirror configuration of PNPs QS84 and QS85 constrains the currents through each transistor to be of equal magnitude. Assuming GD1 to be the active gate drive output, the equal currents flowing through transistors QS84 and 85 force the Vbe voltages on QS88 and QS99 to be duplicated in transistors QS87 and QS98. Since the bases of QS88 and QS89 tie directly to the gate drive outputs GD1 and GD2, the highest of those gate drive voltages is translated through the matching Vbe's to the base of QS87, with an approximately 200 millivolt positive voltage offset being provided by the voltage drop across RS43. This drop, which is simply the value of RS43 times one-half of the bias current provided by QS96, guarantees that the voltage adjustment on $C_{EXT}$ leaves $V_{CEXT}$ slightly above the controlling gate drive output voltage. This condition is necessary to insure that the transition from current limiting operation into soft-shutdown does not cause any discontinuities in the gate drive output voltage. The slight positive offset allows the discharging $V_{CEXT}$ to smoothly pass through the existing gate voltage and begin the slow reduction of gate voltage without any abrupt changes thereto.

Referring again to FIG. 2, at the start of a dwell cycle, the signal G7OUT is high, resetting L6 and L5, thereby forcing signal QB5 to a logic high state. With QB5 high, transistor Q5 is turned on, forcing the output of comparator C2 to a logic low state. The logic high state of QB5 also causes transistor Q2 to be turned off.

Once a time out period has elapsed, comparator C1 sets L5, causing the signal QB5 to switch to a logic low state. At this time, $V_{CEXT}$ is higher than the voltage on the active gate drive output (GD1 or GD2) since TOREF is set up to be greater than the gate voltage required on an IGBT to hold the desired range of current limit levels (approximately 3.9 volts on $C_{EXT}$ versus approximately 2.6 volts on the IGBT gate). Therefore, the output of comparator C2 is low even though transistor Q5 is now turned off. L6 is therefore still reset, causing its Q output to be low. With both inputs to NOR gate G10 low, transistor Q2 is thus turned on, beginning a rapid discharge of $V_{CEXT}$ therethrough. This discharge continues until $V_{CEXT}$ drops below the replicated gate drive voltage at the non-inverting input of comparator C2. With $V_{CEXT}$ below the voltage at the non-inverting input of comparator C2, the output of comparator C2 switches high, setting L6, which causes the Q output of L6 to switch to a high state. This high state causes NOR gate G10 to turn off transistor Q2, thereby halting the rapid discharge of $V_{CEXT}$. At this point, $V_{CEXT}$ has been adjusted from its starting voltage equal to TOREF, down to a few hundred millivolts above the currently active gate drive output voltage. Additionally, switching of the Qbar output of L6 to a low state via the setting of 26 activates follower F1, which couples $V_{CEXT}$ to the active gate drive output.

Figure 7:
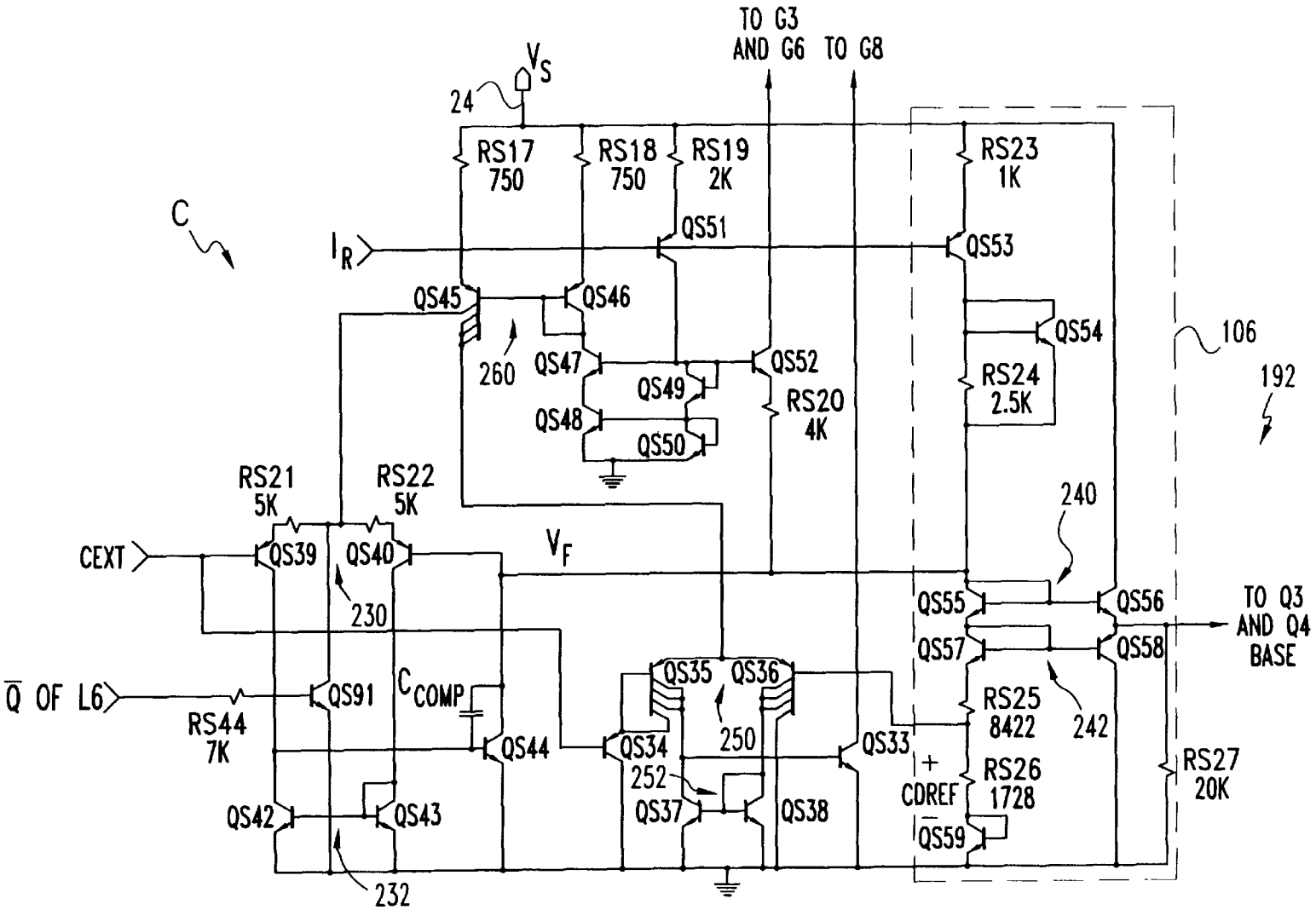
FIG. 7 is a schematic diagram illustrating one preferred embodiment of the block of circuitry labeled "C" in FIG. 2.

Referring now to FIG. 7, one preferred embodiment of circuit block C of FIG. 2 is shown. Transistors QS39 and QS40 are connected as a standard PNP differential input pair 230, the collectors of which connect to a current mirror 232 composed of transistors QS42 and QS43. An output transistor QS44 has its base tied to the collector of transistor QS42 and its collector tied to the base of transistor QS40. This is a known configuration for a voltage follower, with an internal compensation capacitor $C_{COMP}$ included across the collector-base terminals of QS44 for loop stability. Transistors QS39–40 and QS42–44, along with $C_{COMP}$, comprise voltage follower F1 (FIG. 2). Transistor QS91 is connected to the Qbar output of L6 so that when Qbar is high, voltage follower F1 is disabled, and when Qbar is low, transistor QS91 is off, thereby enabling voltage follower F1 to impose a copy of the voltage $V_{CEXT}$ onto the node labeled $V_F$.

The voltage limiter 106 is preferably constructed of the components shown within dash-lined box 106 of FIG. 7. Node $V_F$ is connected to one side of an NPN voltage follower 240 composed of transistors QS55 and 56, the emitters of which are connected to a second voltage follower 242 composed of NPN transistor QS57 and NPN transistor QS58. The emitters of QS56 and QS58 are coupled to ground potential through resistor RS27, and are further connected to the bases of transistors Q3 and Q4 (FIG. 2). The emitter of QS57 is connected to resistor RS25, which is connected to resistor RS26, which is further connected to diode-connected transistor QS59. A node connecting RS25 to RS26 is connected to the base of PNP transistor QS36 which forms a standard PNP input stage 250 of comparator C4. Node $V_F$ is further connected to an emitter of NPN transistor QSS4 and resistor RS24, the opposite end of which is connected to the base and collector of QS54. QS54 is fed by a current referenced to $I_R$. The voltage $V_F$ is translated down one Vbe across the base-emitter junction of QS56, which is subsequently translated back up one Vbe across the base-emitter junction of either Q3 or Q4, forcing the voltage on either GD1 or GD2 to follow the discharging voltage $V_{CEXT}$.

Transistors QS57–59 and resistors RS25–26 are used to set up the reference voltage CDREF of comparator C4, which is comprised of differential input pair 250 and current mirror 252 connected thereto, with one leg of current mirror 252 driving the base of C4 output transistor QS33. The collector of QS33 is connected to the input of inverter G8. The reference voltage CDREF is set up by the current flowing through QS59 and RS26. However, since the base of transistor QS35 is one Vbe above $V_{CEXT}$, the effect of QS59's Vbe is approximately canceled so that the true CDREF voltage relative to the CEXT node is approximately the current flowing through QS59 times RS26. Preferably, CDREF is set at approximately 200 millivolts, which may be easily adjusted by changing the value of RS26 while maintaining the same total resistance of RS25 plus RS26. CDREF is intended to be small to force a nearly complete discharge of capacitor $C_{EXT}$ before the next dwell event can begin, as described hereinabove.

The sum of RS25 and RS26 is important in the set up of the voltage limiter circuit 106. The limiter 106 functions by imposing a pseudo-bandgap voltage developed across RS25–26, QS55, QS57, and QS59 in similar fashion to that described for the THLO reference voltage described hereinabove with respect to FIG. 5. The voltage limiting function provided by circuit 106 protects the gate oxide of the IGBTs from excessive voltage conditions. The limiter of voltage reference $V_F$ is defined by the equation:

$$V_F=[I_{REF}*(RS25+RS26)]+Vbe_{55}+Vbe_{57}+Vbe_{59}.$$

The values of RS25 and RS26 can be chosen such that $V_F$ is relatively temperature independent. This results in a reference voltage $V_F$ which is approximately three times the silicon bandgap voltage, or 3.8 volts. This voltage is transferred to the appropriate gate drive output by translating down one Vbe at QS56, and back up one Vbe at either Q3 or Q4. If the gate drive voltage tries to move above $V_F$, QS58 supplies base drive to Q3 or Q4, causing these transistors to dump excess gate drive current to ground through resistor RS46 (FIG. 8).

Node $V_F$ is further connected to resistor RS20, which is connected to an emitter of NPN transistor QS52, the collector of which is connected to NOR gates G3 and G6. The base of QS52 is connected to the base of QS47 and to diode connected QS49. The emitter of QS49 is connected to the base and collector of QS50, and to the base of QS48, the collector of which is connected to the emitter of QS47. The collector of QS47 is fed by a current mirror 260 composed of transistors QS45 and QS46. The base of transistor QS47 is fed by a current generator referenced by $I_R$.

When the voltage at $V_F$ is higher than the Vbe voltage of QS50, no current passes through QS52 because the base-emitter junction of QS52 is reverse biased. When the voltage at $V_F$ drops below a level defined by $Vbe_{50}+Vbe_{49}-Vbe_{52}$, which is approximately equal to $Vbe_{50}$, QS52 begins to conduct current, thereby pulling down the collector of QS52. Resistor RS20 limits the amount of current drawn by QSS2. This mechanism provides a comparator threshold for comparator C3 which has a negative temperature coefficient similar to that of typical IGBT gate-emitter threshold voltages, allowing the two to track.

Figure 8:
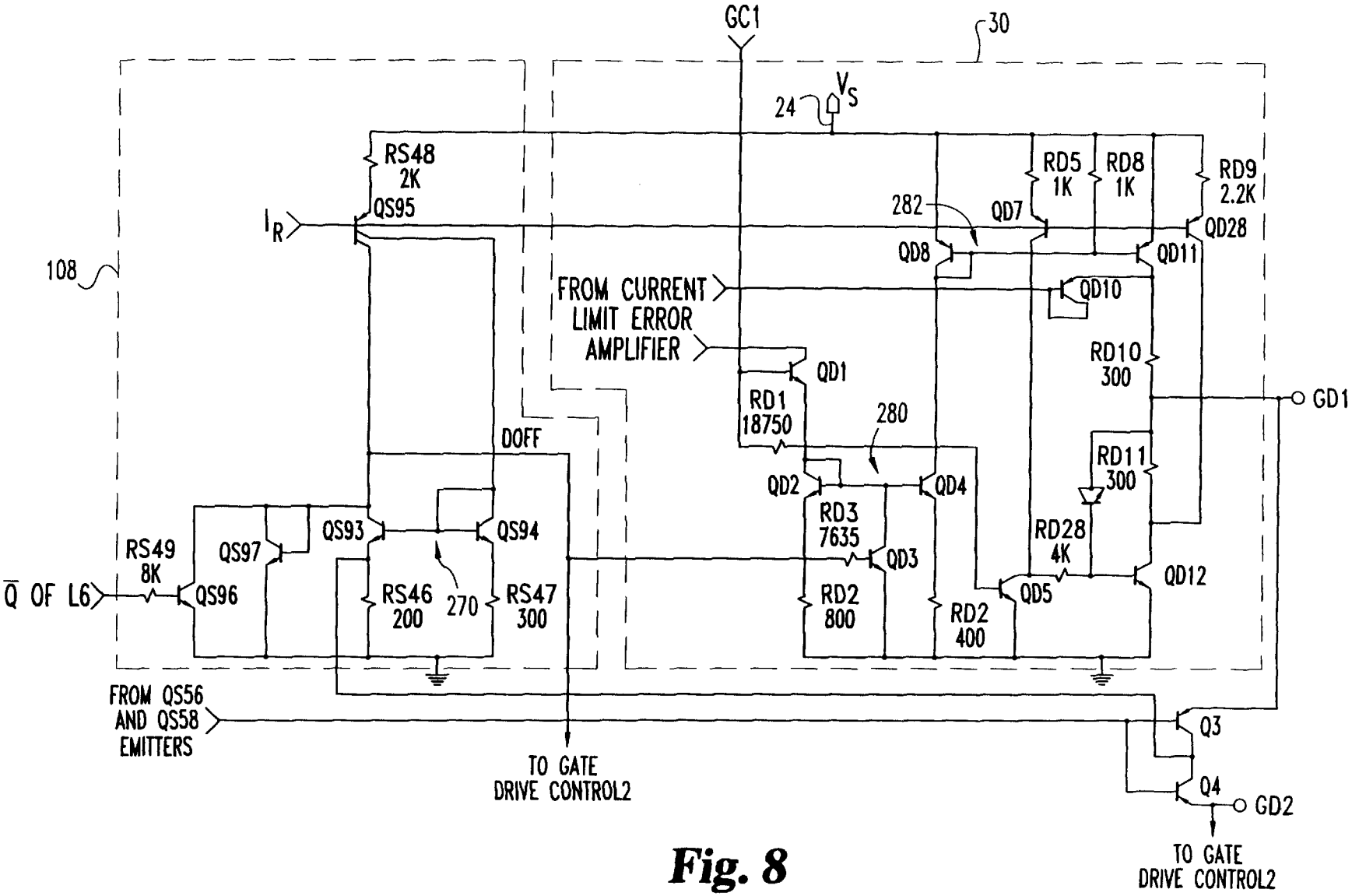
FIG. 8 is a schematic diagram illustrating one preferred embodiment of the block of circuitry labeled "D" in FIG. 2.

Referring now to FIG. 8, one preferred embodiment of circuit block D of FIG. 2 is shown. It should be noted that only gate drive control1 circuit 30 is shown, although identical circuitry for gate drive control2 circuit 32 is actually connected to the emitter of Q4 as indicated by the arrow extending therefrom. It should also be noted that circuitry 30 is known, and is not considered to be part of the present invention.

At any rate, the emitters of QS56 and QS58 (from FIG. 7) are connected to the bases of transistors Q3 and Q4 respectively. The collectors of Q3 and Q4 are connected together, and are further connected to an emitter of QS93 and to a resistor RS46. QS93 forms a current mirror 270 with transistor QS94, an emitter of which is connected to resistor RS47. The collector of QS93 defines the circuit node DOFF, and is connected to a diode-connected transistor QS97 and to a collector of transistor QS96. The base of QS96 is coupled to resistor RS49 through the Q output of L6. The DOFF node is connected to transistor QD3, which is used as described hereinafter to enable or disable current mirror 280, which is composed of transistors QD2 and QD4. Current mirror 280 is further connected to current mirror 282, composed of transistors QD8 and QD11, the collector of which feeds gate drive GD1.

Assuming again that the gate drive GD1 is the active gate drive output, any excess current available at GD1 is passed through Q3 to the emitter of QS93. By virtue of the mismatch between RS46 and RS47, current mirror 270 normally attempts to sink current from the node labeled DOFF. When excess current from GD1 is shunted to the emitter of QS93, this current develops additional voltage drop across RS46, thereby reducing the amount of current passed through QS93. This action results in excess current at the node labeled DOFF, which turns on transistor QD3. The amount of drive to transistor QD3 is linearized by the presence of diode connected QS97 to reduce the gain at this stage. Under normal IGBT drive, whether charging the gate, ramping the coil current, or current limiting, the drive to GD1 is provided by the sequential current mirrors 280 and 282. The node connected to the collector of QD1 normally sources current for the first current mirror 280, which scales the current and passes it to the second mirror 282, where a second scaling may occur. When a drive signal at DOFF activates QD3, the current available to mirror 282 is reduced, thereby reducing the current to output drive GD1. In this fashion, the amount of current that must be removed from GD1 is reduced, allowing better control of the output voltage during soft-shutdown. This control loop is not allowed to be active until the Qbar output of L6 switches low as previously described.

When Qbar of L6 is high, QS96 holds DOFF in an off state. In current limiting operation, the output current to GD1 is also reduced by the current limit error amplifier 46 (FIG. 1) which connects to gate drive control1 circuit 30 at the collector of QD1 and at the collector base of QD10 as shown in FIG. 8. This limiting is no longer active once the soft-shutdown circuit becomes active and the coil current begins its slow ramp downwardly.

The present invention is illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

It is claimed:

1. An electrical load driving system comprising:

a plurality of electrical loads;

a corresponding plurality of load driving devices each operatively connected to a separate one of said loads and each responsive to a separate load driving signal to enable current to flow from a source of current through a respective one of said loads; and a control circuit responsive to an active state of any of a plurality of load control signals to produce corresponding ones of said load driving signals, said control signal inhibiting any of said load driving signals in response to corresponding ones of said load control signals remaining in said active state for a predefined time period and disabling further production of said any of said load driving signals until said corresponding ones of said load control signals transition from an inactive state thereof to said active state, said control circuit permitting production of all other load driving signals in response to their corresponding load driving signals while inhibiting said any of said load driving signals.

2. The system of claim 1 wherein each of said plurality of electrical loads is an automotive ignition coil; and wherein each of said corresponding plurality of load driving devices is operatively connected to a primary coil of a corresponding one of said automotive ignition coils.

3. The system of claim 2 further including an engine control computer producing said load control signals in accordance with engine ignition timing information.

4. The system of claim 2 wherein each of said load driving devices is a power transistor.

5. An electrical load driving system comprising:

a plurality of electrical loads;

a plurality of load driving devices each operatively connected to a separate one of said loads and responsive to one of a corresponding plurality of load driving signals to enable current flow therethrough from a source of current; and a control circuit responsive to an active state of any one of a plurality of load control signals to produce a corresponding one of said plurality of load driving signals while inhibiting production of all other load driving signals, and to an inactive state of said load control signal to inhibit production of only said corresponding load driving signal.

6. The system of claim 5 wherein at least some of said plurality of electrical loads are automotive ignition coils, each of said ignition coils having a primary coil operatively connected to a respective one of said load driving devices and a secondary coil coupled thereto.

7. The system of claim 6 wherein each of said plurality of load driving devices includes a power transistor.

8. The system of claim 7 further including an engine control computer producing said plurality of control signals in accordance with engine ignition timing information.

9. The system of claim 8 wherein each of said power transistors is an insulated gate bipolar transistor.

10. An electrical load driving system comprising:

an electrically inductive load having a primary coil coupled to a secondary coil;

a load driving device operatively connected to said primary coil, said load driving device responsive to an active state of a first signal to enable current to flow from a source of current through said load and to an abrupt transition from said active state to an inactive state of said first signal to Produce a voltage spike in said secondary coil; and a control circuit responsive to an active state of a second signal to produce said active state of said first signal, said control circuit gradually decreasing said first signal from said active state to said inactive state thereof to avoid production of said voltage spike in said secondary coil in response to a fault condition associated with said second signal, said control circuit further including a capacitor connected to a first current source of said control circuit, said first current source responsive to a transition of said second signal from said inactive state to said active state to produce a first current operable to commence charging of said capacitor from a substantially uncharged state, said fault condition corresponding to said capacitor charge exceeding a predefined charge level;

wherein the duration of charging said capacitor from said substantially uncharged state to the occurrence of said fault condition defines a timeout time period;

and wherein said control circuit further includes a first comparator having a first input connected to said capacitor and a second input connected to a voltage reference corresponding to said predefined charge level, said first comparator triggering said fault condition if said capacitor charge exceeds said voltage reference.

11. The system of claim 10 wherein said voltage reference produces a substantially constant voltage corresponding to said predefined charge level.

12. The system of claim 10 further including a resistor coupled to said first current source, said resistor defining a current value of said first current, said first current value defining a rate at which said capacitor charges from said substantially uncharged state.

13. The system of claim 12 wherein said voltage reference produces a voltage corresponding to said predefined charge level and having a predefined temperature coefficient associated therewith.

14. The system of claim 13 wherein one of said capacitor and said resistor has said predefined temperature coefficient associated therewith, said predefined temperature coefficient of said voltage reference compensating for said predefined temperature coefficient of said one of said capacitor and said resistor so that said timeout time period is substantially temperature independent.

15. The system of claim 10 further including a resistor coupled to said first current source, said resistor defining a current value of said first current, said first current value defining a rate at which said capacitor charges from said substantially uncharged state.

16. The system of claim 10 wherein said control circuit further includes:

a drive circuit responsive to said active state of said second signal to produce said active state of said first signal at a drive circuit output thereof; and a transfer circuit connected to said capacitor and to said drive circuit output, said transfer circuit responsive to said fault condition to couple said capacitor to said drive circuit output.

17. The system of claim 16 wherein said control circuit further includes a voltage reduction circuit responsive to said fault condition to reduce said capacitor charge to a first voltage level equal to said active state of said first signal plus a predefined offset voltage level.

18. The system of claim 17 wherein said control circuit further includes a second current source connected to said capacitor, said second current source responsive to said fault condition to produce a second current operable to gradually decrease said capacitor charge to a second voltage level below which an abrupt transition of said second voltage level to an inactive state will not result in production of said voltage spike in said secondary coil.

19. The system of claim 18 wherein said control circuit further includes a charge reset circuit responsive to said second voltage level to substantially discharge said capacitor, said charge reset circuit maintaining said capacitor substantially discharged until said second signal transitions from an inactive state to an active state thereof.

* * * * *